US005965517A

United States Patent [19]

Mooney

[11] Patent Number: 5,965,517

[45] Date of Patent: Oct. 12, 1999

[54] FABRIC TREATMENT COMPOSITION

[75] Inventor: William Mooney, Great Sankey, United Kingdom

[73] Assignee: Lever Brothers Company, Division of Conopco,Inc., New York, N.Y.

[21] Appl. No.: 08/890,431

[22] Filed: Jul. 9, 1997

[30] Foreign Application Priority Data

Jul. 25, 1996 [GB] United Kingdom ..... 9615613

[51] Int. Cl.[6] ..... D06M 13/184; D06M 13/224

[52] U.S. Cl. ..... 510/516; 252/8.61; 252/8.63; 252/8.91; 427/393.2; 510/513; 510/521; 510/527

[58] Field of Search ..... 252/8.61, 8.63, 252/8.91; 510/513, 516, 521, 527; 427/393.2

[56] References Cited

U.S. PATENT DOCUMENTS

| | | | |
|---|---|---|---|
| 3,656,246 | 4/1972 | Lord | 8/115.7 |
| 3,954,630 | 5/1976 | Ramachandran | 8/137 |
| 4,820,307 | 4/1989 | Welch et al. | 8/120 |
| 4,828,722 | 5/1989 | Steltenkamp | 510/328 |
| 5,042,986 | 8/1991 | Kitchens et al. | 8/120 |
| 5,199,953 | 4/1993 | Fung et al. | 8/120 |
| 5,296,269 | 3/1994 | Yang et al. | 427/393.2 |
| 5,496,476 | 3/1996 | Tang et al. | 252/8.61 |
| 5,496,477 | 3/1996 | Tang et al. | 252/8.61 |

FOREIGN PATENT DOCUMENTS

| | | |
|---|---|---|
| 0 354648 | 2/1990 | European Pat. Off. . |
| 0572923 | 12/1993 | European Pat. Off. . |
| 94/1943//9 | 9/1994 | WIPO . |

OTHER PUBLICATIONS

Chemical Abstract No. 102:8641 which is an abstract of German Patent Specification No. 3312328 (Oct. 1984).

Chemical Abstract No. 110:54916 which is an abstract of an article by Welch entitled "Tetracarboxylic Acids . . . Durability Studies" Text. Res. J, 58(8), pp. 480–486 (1988), No Month.

Chemical Abstract No. 110:1755539 which is an abstract of Japanese Patent Specification No. 63–254199 (Oct. 1988).

Chemical Abstract No. 126:187332 which is an abstract of German Patent Specification No. 19526089 (Jan. 1997).

Chemical Abstract No. 127:264125 which is an abstract of an article by Lewis et al entitled "Durable Press Finishing . . . S–triazine" J. Appl. Polym. Sci, 66(1), pp. 171–177 (1997), No Month.

Chemical Abstract No. 127:319981 which is an abstract of an article by Welch et al entitled "Malic Acid . . . Polymer Additives" Text. Chem. Color., 29(10), pp. 33–37 (1997), No Month.

Int'l Search Report Application No. PCT/EP 97/03913 mailed Nov. 11, 1997.

"Textile, Chemist and Colourist", Nov., 1992, vol. 24, No. 11.

Textile Research Journal, Clark M. Welch, "Tetracarboxylic Acids as Formaldehyde–Free Durable Press Finishing Agents", pp. 480–486 [No Date].

STN International, File CAPLUS, CAPLUS accession No. 122:33466, Choi, Hyung–min et al., "Single–step dyeing and finishing treatment of cotton with 1,2,3,4–butanetetracarboxylic acid", J. Appl. Polym. Sci. (1994), No Month 54(13), 2107–18.

*Primary Examiner*—Anthony Green
*Attorney, Agent, or Firm*—Neil Y. Gilbert, Esq.

[57] ABSTRACT

A method of treating fabric comprising:

i) applying a composition comprising a polycarboxylic acid or derivative thereof; and ii) curing the composition using a domestic process, is described herein. The invention also relates to compositions for use in said method.

17 Claims, No Drawings

FABRIC TREATMENT COMPOSITION

TECHNICAL FIELD

The present invention relates to fabric care compositions, in particular the invention relates to fabric care compositions that reduce fabric creasing.

BACKGROUND AND PRIOR ART

When articles are purchased the fabrics from which they are made are crease free. During laundering or wear/use the fabrics crease, the consumer then removes these creases to a lesser extent by tumble drying and to a greater extent by ironing. During use or wear of the articles the fabric crease again, further laundering exacerbates the problem and so the cycle continues.

In order to prevent fabrics creasing there are a number of industrial processes available which are used to treat the fabrics. These industrial processes are reviewed in "Textile Chemist and Colourist" November 1992 vol 24, No 11. However these industrial processes change the nature and feel of the fabric and so have not been used domestically.

The present invention describes compositions that can be used to reduce creasing of the fabrics during wear and in the subsequent laundering of the fabric. It has been found that the drape and/or tactile properties are not adversely affected.

A secondary advantage of the methods and compositions described herein is to improve wrinkle performance in combination with improved colour durability of the textile. It is believed that lower surface nap and pill formation lead to reduced light scattering and better colour perception.

DEFINITION OF THE INVENTION

This according to a first aspect of the invention provides a method of treating fabric comprising the following steps:

i)applying a composition comprising a polycarboxylic acid or derivative thereof;

ii)curing the composition using a domestic process.

The invention further provides a method of treating fabric in which a composition comprising a polycarboxylic acid or derivative thereof having 3 or more carboxyl groups, is applied to the fabric by means of a spray.

The invention provides the use of a polycarboxylic acid or derivative thereof within a rinse conditioner or an ironing aid composition to reduce creasing of fabrics treated with said rinse conditioner compositions during wear or use.

A further aspect of the invention provides a composition comprising:

i) a fabric softening compound; and ii) 0.01 to 5 wt % of the total composition of a polycarboxylic acid or derivative thereof having 4 or more carboxyl groups.

A further aspect of the invention relates to a composition comprising:

i) a fabric softening compound selected from the group consisting of cationic softeners or nonionic softeners or mixtures thereof; and ii) a polycarboxylic acid or derivative thereof having 4 or more carboxyl groups.

DETAILED DESCRIPTION OF THE INVENTION

The present invention relates to compositions for use in a setting, especially a domestic laundry setting.

The compositions of the invention contain a polycarboxylic acid or derivative thereof. In the context of the present invention it is preferred that the polycarboxylic acid or derivatives contains at least 3 carboxyl groups, preferably between 4 and 8 carboxyl groups. It is especially preferred if at least 3 carboxyl groups, and more preferably 4 or more carboxyl groups, of the polycarboxylic acid or derivatives thereof are situated on adjacent carbon atoms. Also within the polycarboxylic acid or derivatives of the present invention are oligomers comprising monomers of the aforementioned polycarboxylic acids or derivatives thereof.

The oligomers may contain saturated or unsaturated monomers. Examples of the oligomeric polycarboxylic acids include polymaleic acid, cyclic polyacids containing varying degrees of unsaturation. Unsaturated linear poly (oligomeric carboxylic acids may also be used.

The polycarboxylic acid derivatives of the invention may have 1 to 4 of the carboxyl groups esterified with a short chain ($C_1$–$C_4$, more preferably $C_{1-C2}$) alcohol or from a salt with a suitable counterion, for example alkali metal, alkaline earth metal, ammonium compound. In addition the polycarboxylic acid or its derivative may contain a long chain ($C_8$–$C_{22}$. preferably $C_{12}$–$C_{18}$) alkyl, alkenyl or acyl group.

The preferred polycarboxylic acids have the formula:

$$X\text{—}[CO_2R]_n$$

in which n is equal to 4 or more, X is a hydrocarbon backbone optionally substituted with functionalities including $C_1$–$C_6$alk(en)yl, hydroxy, and acyloxy derivatives, R is independently selected from a $C_1$ to $C_4$ alkyl chain or a $C_2$ to $C_4$ alkenyl chain, or salt but is is preferably H.

A preferred polycarboxylic acids is 1,2,3,4 cyclopentanetetracarboxylic acid. A particularly preferred polycarboxylic acid is 1,2,3,4 butanetetracarboxylic acid (BCTA).

Unsaturated polycarboxylic acids have been found to cure at lower temperatures and may be particularly advantageous for use on synthetic fabrics, especially where the fabric will be ironed.

The above acids and/or citric acid may be used in a composition for delivery onto fabric using a spray mechanism.

It is desirable if the level of polycarboxylic acid or derivative thereof is from 0.01 wt % to 5 wt % of the total composition, preferably from 0.1 wt % to 5 wt %.

If the composition is to be used in a laundry process as part of a conventional fabric treatment product, such as a rinse conditioner, it is preferable if the level of polycarboxylic acid or derivative thereof is from 0.01 wt % to 5wt %, preferably 0.05wt % to 2.5wt %, most preferably 0.1wt % to 1.5 wt % of the total composition.

If however the composition is to be used in a laundry process as a product to specifically treat the fabric to reduce creasing higher levels of polycarboxylic acid or derivative thereof should be used preferably in amounts of from 0.01wt % to 3wt %, more preferably 0.05wt % to 2.5wt % for example from 0.04wt. % to 1.0wt. % of the total composition.

If the composition is to be use in a spray product it is preferred if the level of polycarboxylic acid or derivative thereof is from 0.5wt. % to 3wt., % preferably 0.5wt. % to 2 wt. % of the total composition.

If high levels of polycarboxylic acid or derivative thereof are used the fabrics may tend to yellow if the curing of the colycarboxylic acid or derivatives is effected under severe conditions, or, if the amount of said acid or derivative adhering to the fabric is excessive. Another disadvantage with using high levels of polycarboxylic acid or derivative thereof is that the fabrics treated therewith change their tactile properties.

Without being bound by theory it is thought that polycarboxy groups reduce creasing of the fabric in that cross-linking occurs via ester bonding. It is advantageous if a catalyst is used with compositions of the invention to aid the formation of the ester links. Preferred catalysts are 1,2,4-triazole, 1,-H-1,2,3-triazole, 1-H-tetrazole, 3-methyl pyrazole, 3-methyl pyridazine, 1-H-purine, 2,3-pyrazine dicarboxylic acid, 2-dimethylamino pyridine, picolinic acid, 6-methyl-3,3-pyridine dicarboxylic acid. imidazole, 1-methylimidazole, 2-methylimidazole, 4-methylimidazole, 2-ethylimidazole, 1-vinylimidazole, 1,2-dimethylimidazole, 2-ethyl-4-methylimidazole. Other catalysts includes salts of organic acids such as moon-, DI-, and trio-, sodium citrate, moon-, DI- sodium mallet, moon-, DI- sodium fumigate, and similar salts of succinct and tartaric acids. Inorganic catalysts include sodium carbonate, sodium dihydrogen phosphate, sodium monohydrogen phosphate, sodium pyrophosphate, sodium acid pyrophosphate and especially preferred is $Na_2H_2PO_2$.

When the polycarboxylic acid is BTCA the preferred catalyst is $NaH_2PO_2$. It is preferred that the catalyst is used in a molar ratio of from 3:1 to 1:3, preferably 1.5:1 to 1:1.5 for example 1:1.

It is preferred if the level of catalyst is from 10% to 90% by weight of the polycarboxylic acid or derivative thereof, especially 30 to 80%.

The formulation preferably contain a fabric softening compound. The fabric softener is either a compound comprising a polar head group and a single alkyl or alkenyl chain of chain length greater than $C_{20}$ or more preferably a compound comprising a polar head group and two alkyl chains each having an average chain length greater than $C_{14}$. For both types of compound it is preferred if the polar head group is cationic such as a quaternary ammonium group.

In the context of the present invention the presence of the fabric softening compound and in particular a cationic fabric softening compound aids the deposition of the polycarboxylic acid or derivative thereof. A further advantage of using a cationic softening compound is that it aids lubrication of the fabric.

Preferably the fabric softening compound of the invention has two long chain alkyl or alkenyl chains with an average chain length greater than $C_{14}$. More preferably each chain has an average chain length greater than $C_{16}$, and more preferably at least 50% of each long chain alkyl or alkenyl group has a chain length of $C_{18}$.

It is preferred if the long chain alkyl or alkenyl groups of the fabric softening compound are predominantly linear.

The fabric softening compositions of the invention are compounds molecules which provide excellent softening, characterised by chain melting—Lβ to Lα-transition temperature greater than 250°C., preferably greater than 35° C., most preferably greater than 45° C. This Lβ to Lα transition can be measured by DSc as defined in "Handbook of Lipid Bilayers, D Marsh, CRC Press, BOAC Rattan Fla., 1990 (Pages 137 and 337).

Substantially water-insoluble fabric softening compounds in the context of this invention are defined as fabric softening compounds having a solubility less than $1\times10^{-3}$wt. in demineralised water at 20° C. Preferably the fabric softening compounds have a solubility less than $1\times10^{-4}$wt, most preferably the fabric softening compounds have a solubility of from $1\times10^{-8}$ to $1\times10^{-6}$.

It is especially preferred if the fabric softening compound is a water insoluble quaternary ammonium material which comprises a compound having two $C_{12-18}$ alkyl or alkenyl groups connected to the molecule via at least one an ester link. It is more preferred if the quaternary ammonium material has two ester links present. A preferred ester-linked quaternary ammonium material for use in the invention can be represented by the formula:

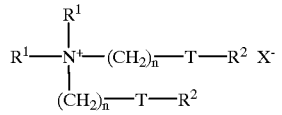

wherein each $R^1$ group is independently selected from $C_{1-4}$ alkyl, hydroxyalkyl or $C_{2-4}$ alkenyl groups; $X^-$ is a suitable anion and wherein each $R^2$ group is independently selected from $C_{8-28}$ alkyl or alkenyl groups;

T is

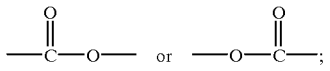

and n is an integer from 0–5.

A preferred material of this class is N-N-di(tallowoyloxy-ethyl) N,N-dimethyl ammonium chloride.

A second preferred type of quaternary ammonium material can be represented by the formula:

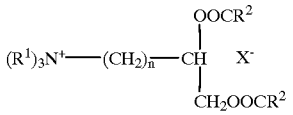

wherein $R^1$, n, $R^2$ and $X^-$ are as defined above.

Preferred materials of this class such as 1,2 bis[hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy -2-hydroxy trimethylammonium propane chloride.

It is advantageous for environmental reasons if the quaternary ammonium material is biologically degradable.

The fabric softening compound of the composition may also be compounds having the following formula:

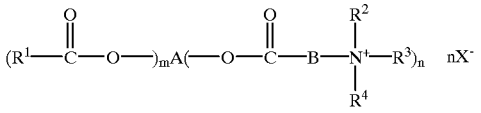

wherein X is an anion, A is an (m+n) valent radical remaining after the removal of (m+n) hydroxy groups from an aliphatic polyol having p hydroxy groups and an atomic ratio of carbon to oxygen in the range of 1.0 to 3.0 and up to 2 groups per hydroxy group selected from ethylene oxide and propylene oxide, m is 0 or an integer from 1 to p-n, n is an integer from 1 to p-m, and p is an integer of at least 2, B is an alkylene or alkylidene group containing 1 to 4 carbon atoms, $R^1$, $R^2$, $R^3$ and $R^4$ are, independently from each other, straight or branched chain $C_1$–$C_{48}$ alkyl or alkenyl groups, optionally with substitution by one or more functional groups and/or interruption by at most 10 ethylene oxide and/or propylene oxide groups, or by at most two functional groups selected from

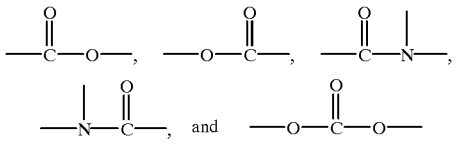

or $R^2$ and $R^3$ may form a ring system containing 5 or 6 atoms in the ring, with the proviso that the average compound either has at least one R group having 22–48 carbon atoms, or at least two R groups having 16–20 carbon atoms, or at least three R groups having 10–14 carbon atoms.

The composition may also contain nonionic fabric softening agents such as lanolin and derivatives thereof.

The performance of the invention has been enhanced by the inclusion of polyethylenes, silicones High medium or low density polyethylenes can be used as co-additives. Polyethylenes can be incorporated into the formulation at the melt stage but the high melting point, 88° C. to 140° C., necessitates production under pressure. A more satisfactory procedure is to blend a ready made polyethylene emulsion into the softener formulation. The polyethylene will contribute a small degree of softening. Nonionic, anionic, amphoteric and cationic dispersions can all be used. The cationic and amphoteric dispersions are easy to use and pose few compatibility problems. Nonionic emulsions give satisfactory results but exhaustion from the rinse water can be less reliable. Anionically dispersed polyethylenes are the simplest to prepare and the most widely available but they tend to complex with cationic softeners. Fortunately the experienced formulator can use techniques which allow the addition of anionic polyethylene dispersions to a cationic rinse conditioner formulation. Further such formulations will exhaust efficiently onto the fabric from a rinse cycle. The preferred polyethylene is low density material in the form of an anionic dispersion. A typical oxidised polyethylene is Luwax OA from BASF. An anionic dispersion is exemplified in Poligen WEl also from BASF.

Paraffinic waxes and oils can also be included in formulations to effect ease of ironing and such materials will improve the creasing properties of the fabric. Paraffin waxes are more easily included in formulations by those practised in the art as they have much lower melting points (50° C. to 60° C.).

Silicones can be added to the formulation to enhance wrinkle control and to improve the handle characteristics of the garments. The most basic silicones, dimethyl siloxanes, are the least expensive but are effective additives. These usually have a viscosity of 10,000 to over 100,000 cS(mPas). Higher molecular weight materials are more difficult to formulate. Aminofunctional silicones are particularly effective in this application. Such compounds are available in a wide variety of forms with optimised amine contents. Reactive silicones cross-link to form an elastomeric matrix and also enhance the wrinkle performance.

Excessive amounts of silicone in the formulation produce undesirable effects such as silicone build-up in washing machines, yellowing of garments, changes in visual appearance, excessive pilling, poor soiling performance and so on.

Typical silicones are Wacker CT94E, VP1445E, CT29E and similar materials. These are mechanical emulsions with the familiar white or milky appearance. Microemulsion silicones are particularly effective in this application especially the aminosilicone types.

Domestic curing of the fabric can be caused by the heat used to dry the fabric, e.g. by tumble drying. Ironing is also particularly advantageous for curing the fabric. Without being bound by theory it is thought that the shorter time or the low temperatures used to domestically cure the polycarboxylic acid or derivative thereof mean that the fabric is made resistant to creasing without changing its tactile, or drape properties.

If the composition is to be added to the rinse liquor the level of fabric softening compounds is preferably from 3 to 60 wt % more preferably from 8 to 50 wt %, most preferably from 8 to 30 wt %. The formulation may be in a form suitable for spraying onto a fabric. If this is the case it preferred if the polycarboxylic acid or derivative thereof is present at a level form 1 to 5 wt % preferably 1.5 to 3 wt %, most preferably 0.75 to 2.5 wt % of the total composition. If the product is to be used in a spray on product it is also beneficial if wetting agents are also present such as alcohol ethoxylates for example Synperonic A7.

For a spray on formulation anionic surfactant may be present.

Suitable spray dispensing devices are disclosed in WO 96/15310 (Procter and Gamble) and are incorporated herein by reference.

Spray products may contain water as a carrier molecule. In some cases to reduce wrinkling of the fabric it is beneficial for spray products to further comprise ethanol isopropanol or a glycol .

The composition may also contain a nonionic stabilising agent, it is preferred if the nonionic stabilising agent is present at a level of from 0.1 to 10.0% by weight and preferably at a level of from 0.2 to 2.5% by weight.

Most preferred nonionic stabilising agents are the ethoxylated long chain fatty alcohols.

The composition may also contain long chain fatty acid material for example $C_8$–$C_{24}$ alkyl or alkenyl monocarboxylic acids or polymers thereof. Preferably saturated fatty acids are used, in particular hardened tallow $C_{16}$–$C_{18}$ fatty acids. Preferably the fatty acid is non-saponified, more preferably the fatty acid is free for example oleic acid. lauric acid or tallow fatty acid.

The compositions of the present invention are typically in a liquid form, but a powder or granulate form is also possible. Suitable composition forms include those for use in a tumble dryer.

The composition can also contain one or more optional ingredients, selected from non-aqueous solvents, pH buffering agents, perfumes, perfume carriers, fluorescers, colorants, hydrotropes, antifoaming agents, antiredeposition agents, polymeric thickeners enzymes, optical brightening agents, opacifiers, anti-shrinking agents, anti-spotting agents, germicides, fungicides, anti-oxidants, anti-corrosion agents, drape imparting agents, antistatic agents and ironing aids.

The compositions of the invention preferably have a pH of at least 1.5, and more preferably less than 5.

The invention will now be illustrated by the following non-limiting examples. In the examples all percentages are expressed by weight. Comparative Examples are designated by letters, while Examples of the invention are designated by numbers.

Preparation of Examples
Examples 1 to 4 and Example A - Spray on Formulation

| Component | Example A | Example 1 | Example 2 | Example 3 | Example 4 |
|---|---|---|---|---|---|
| BTCA[1] | — | 1.0% | 1.0% | 1.0% | 1% |
| $NaH_2PO_2$ | — | 0.4% | 0.4% | 0.4% | 0.4% |
| HEQ[2] (Cationic Softener | 0.05% | 0.5% | 0.05% | 0.05% | — |
| Alcohol ethoxylate[3] | 0.01% | 0.01% | 0.01% | 0.01% | 0.01% |
| Polyethylene Emul[4] | 0.05% | 0.05% | — | — | — |
| Silicone (Wacker VP1445E) | | | 0.05% | — | — |
| Water | | | To 100% | | |

[1]BTCA is 1,2,3,4 butanetetracarboxylic acid
[2]HEQ is a cationic fabric softener; 1,2 dihardened tallowoyloxy-3-trimethylammonio propane chloride ex Hoescht.
[3]is Synperonic A7 is $C_{13}$–$C_{15}$ alcohol ethoxylated with 7 moles of ethylene oxide
[4]is Poligen WE1 a dispersion of oxidised polyethylene (ex BASF).

The Examples were prepared by melting the HEQ and alcohol ethoxylate together at 80° C. Half the water is added at this temperature and the mixture stirred until homogeneous. The BTCA and the $Na_2H_2PO_2$ are dissolved in the remaining water at room temperature and added to the hot mix allowing the temperature to drop whilst stirring for several minutes. Finally the polyethylene is added and rapid stirring is continued until mixing is complete and the temperature is below 30° C.

To test the efficacy of Examples 1 to 4 the samples were sprayed onto a sample of cotton poplin fabric (20×30 cm) which was pre wrinkled (by forming a cylinder and placing under a 1 kg weight for 30 minutes). The ease of wrinkle removal was assessed. The samples were weighed and spray application was continued to a level of 100% pick up of the solution based on the weight of fabric. These were gently dried with the iron and then ironed with a little more deliberation to cure the finish. The cure technique consisted of moving the iron across the fabric at about 2 cm per second. The iron setting was for cotton. Wrinkles were easier to remove for Example 1. The Examples were then subjected to a 50° C. wash cycle with a standard washing powder. On removal from the washing machine the Examples of the invention were visibly less creased. Subsequent tumble drying removed more creases and further emphasised the lower tendency of Examples 1 to 4 form creases during wetting. The results obtained for the above spray on-formulations are given in table la below.

TABLE 1

| Example | Ease of Crease Removal | Creasing during laundering |
|---|---|---|
| A | 2.2 | 2.0 |
| 1 | 3.5 | 4.2 |
| 2 | 3.4 | 4.0 |
| 3 | 3.0 | 3.8 |
| 4 | 2.8 | 3.2 |

1 = poor, 5 = very good.

Examples 5,6,7 and B Rinse Conditioner Formulations (Table 2):

Examples 5,6, and 7 were designed for repeated application so that an obvious improvement in wrinkle control would be noticed after about 5 wash iron wear cycles. This offsets the slow loss of textile finish and loss of fabric resilience and drape with repeated washing.

TABLE 2

| Component | Examples wt % | | | |
|---|---|---|---|---|
| | B | 5 | 6 | 7 |
| BTCA[1] | — | 0.5 | 0.5 | 0.5 |
| $NaH_2PO_2$ | — | 0.2 | 0.2 | 0.2 |
| HEQ[2] | 5.0 | 5.0 | 5.0 | 5.0 |
| Silicone[5] | — | — | 1.0 | — |
| Polyethylene Emul[4] | — | — | — | 1.0 |
| Water | | To 100% | | |

[5]is VP1445E ex Wacker

Footnotes 1,2, and 4 are described in the table entitled'Examples 1 to 4 and Example A—Spray on Formulation'.

The HEQ was melted at 80° C. and mixed with half the water at this temperature. The BTCA and catalyst were dissolved in the remaining water at room temperature and added to the softener dispersion. Stirring was continued until the emulsion was homogeneous and the temperature was below 30° C.

This preparation was then applied at 5 wt % by exhaustion from a rinse bath at Liquor ratio of 25:1 over a treatment time of 5 min. After tumble drying, the fabric was ironed using the "cotton" setting. For test purposes the speed of traverse of the iron was Cm per sec., and both sides of the fabric were ironed.

The wrinkle reduction for examples 5,6, and 7 was perceivable on emerging from the 5th wash whilst the fabrics were still wet and after tumble drying.

Wrinkle recovery and crease recovery angles were measured in accordance with current standard methodology (AATCC TM 128).

AATCC TM 128 is the American standard in which the degree of wrinkling of the fabric is compared with a set of standards (0 highly wrinkled 5 no/few wrinkles). A sample of fabric (20 cm×30 cm) is formed into a cylinder in a specialised device which collapes the structure with a degree of axiel rotation using a specific weight. After a time the wrinkled fabric is removed and the degree of creasing assessed against a 1 to 5 scale.

Table 3 demonstrates the results of the tests. This illustrates the synergistic improvement obtained by the inclusion of silicones or polyethythlene in the formulations. The crease recovery angle was measured according to British standard 1553086. A sample of fabric (25 mm×50 mm) is folded in half forming a sharp crease and held under a weight of 500 g for up to 5 mins. On releasing the sample the crease opens up to a certain degree. The final angle is measured as the crease recovery angle.

TABLE 3

| Example | Wrinkle recovery Rating 1 = Poor 5 = no wrinkles | Crease Recovery Angle Warp + Weft |
|---|---|---|
| Water | 2.6 | 140° C. |
| Example B (softener only) | 2.5 | 160° C. |
| Example 5 (BTCA + softener) | 2.9 | 185° C. |
| Example 6 (BTCA + softener + silicone) | 3.0 | 190° C. |
| Example 7 (BTCA + softener + Polyethylene | 3.4 | 195° C. |

The greater the crease recovery angle the greater the ability of the fabric to resist or prevent creasing. It can be seen that the presence of BCTCA with a cationic softener (example 5) provided improved crease resistance when compared to water treatment or a cationic softener but no polycarboxylic acid or derivative. The addition of either a silicone or a polyethylene to example 5 (example 6 and 7 respectively) showed further improvement.

Examples 8, 9 and 10 Rinse Conditioners also Containing Citric Acid.

Examples 8,9 and 10 were also designed for repeated application as noted above with respect to Examples 5, 6 and 7.

TABLE 4

| | Examples wt. % | | |
|---|---|---|---|
| Component | 8 | 9 | 10 |
| BTCA[1] | 0.5 | — | 0.4 |
| $NaH_2PO_2$ | 0.2 | 0.2 | 0.2 |
| HEQ[2] | 5.0 | 5.0 | 5.0 |
| Citric Acid | — | 0.5 | 0.5 |
| Water | | to 100% | |

The compositions were prepared by the same method as for examples 5,6 and 7 and were applied and cured etc. in the same way. The wrinkle recovery and crease recovery angle were measured as above.

TABLE 5

| Example | Wrinkle Recovery (rating) | Crease Recovery Angle Warp & Weft |
|---|---|---|
| 8 | 2.9 | 185° C. |
| 9 | 2.6 | 168° C. |
| 10 | 2.8 | 180° C. |

Example 11

A small sample of cotton interlock, reactive dyed to a royal blue shade was treated with a spray on composition containing a cationic softeners and BTCA (3% on weight of fabric). After iron curing and re-laundering this fabric and a control were subjected to accelerated abrasion in a Martindale tester. A laboratory panel rated the samples as follows.

I claim:

1. A method of treating fabric to reduce creasing during wear or use comprising the following steps:

i) applying to a fabric a fabric care composition comprising 0.01 wt % to 5 wt % of a polycarboxylic acid having at least 4 carboxyl groups or a derivative thereof, and ii) curing the composition using a domestic process comprising a curing step, said curing step being selected from:

using heat to dry the fabric obtained from step (i);

b) ironing the fabric obtained from the step (i); or a combination of a) or b).

2. A method according to claim 1 in which the composition applied to the fabric further comprises a fabric softening compound which is a cationic fabric softening compound, or a nonionic softening compound, or a mixture thereof, in an amount sufficient to lubricate the fabric and to aid the deposition of the polycarboxylic acid having 4 or more carboxyl groups or derivative thereof.

3. A method according to claim 1 in which the composition is applied to the fabric during laundering.

4. A method according to claim 1 wherein the composition is applied to the fabric by means of a spray.

5. A process for reducing the creasing of fabrics during wear or use which comprises treating said fabrics with a rinse conditioner composition comprising 0.01 wt % to 5 wt % of a polycarboxylic acid having at least 4 carboxyl groups or derivatives thereof.

6. A process for reducing the creasing of fabrics during wear or use which comprises treating said fabrics with an ironing aid composition comprising 0.01% wt % to 5 wt % of a polycarboxylic acid having 3 or more carboxyl groups or derivative thereof.

7. A fabric care composition comprising:

i) a fabric softening compound which is a cationic fabric softening compound, or a nonionic softening compound, or a mixture thereof, in an amount sufficient to lubricate the fabric and to aid the deposition of a polycarboxylic acid or derivative thereof and;

ii) 0.01 to 5 wt. % of the total composition of a polycarboxylic acid having 4 or more carboxyl groups or derivative thereof.

8. A composition according to claim 7 in which said polycarboxylic acid or derivative thereof is present in an amount of from 0.01 wt % to 3 wt %.

9. A composition according to claim 7 in which the polycarboxylic acid is 1,2,3,4 butanetetracarboxylic acid.

10. A composition according to claim 7 which further comprises a catalyst for the polycarboxylic acid or derivative thereof in an amount of from about 10% to about 90% by weight of the polycarboxylic acid or derivative thereof.

11. A composition according to claim 10 in which the catalyst is $NaH_2PO_2$.

12. A composition according to claim 7 which is in a liquid form.

13. A composition according to a claim 7 which further comprises a silicone.

14. A composition according to claim 7 which further comprises a polyethylene.

15. A composition according to claim 7 which further comprises a nonionic stabilizing agent.

16. A composition according to claim 7 which has been cured by a curing step, said curing step selected from:

a) using heat to dry fabric which has been treated by the composition;

b) ironing the fabric which has been treated with the composition; or a combination of a) and b).

17. A composition according to claim 7, wherein said composition is in the form of a rinse conditioner or a spray-on formulation.

* * * * *